US005724736A

United States Patent [19]

Smith

[11] Patent Number: 5,724,736

[45] Date of Patent: Mar. 10, 1998

[54] HAIR CUTTING DEVICE

[76] Inventor: James E. Smith, 10 Elm St., Saraland, Ala. 36571

[21] Appl. No.: 744,094

[22] Filed: Nov. 5, 1996

[51] Int. Cl.[6] ..... B26B 19/44

[52] U.S. Cl. ..... 30/133; 30/30

[58] Field of Search ..... 30/133, 131, 132, 30/30, 31, 200, 201, 41.5, 195

[56] References Cited

U.S. PATENT DOCUMENTS

| | | | |
|---|---|---|---|
| 2,249,293 | 7/1941 | King | 30/133 |
| 4,030,196 | 6/1977 | Koiwa et al. | 30/133 |
| 4,146,960 | 4/1979 | Flowers et al. | 30/195 |
| 5,031,320 | 7/1991 | Persyn | 30/133 |
| 5,060,380 | 10/1991 | Fujikawa | 30/200 |
| 5,142,786 | 9/1992 | Hunts | 30/133 |
| 5,377,411 | 1/1995 | Andriotis | 30/133 |
| 5,519,939 | 5/1996 | Smith | 30/30 |

*Primary Examiner*—Hwei-Siu Payer

[57] ABSTRACT

An improved hair cutting device (10) having a housing (12) having a housing front (12A) with a housing front vertical member (12AA) and a housing front horizontal member (12AB) attached to a housing front bottom support member (12AC). The housing (12) further has a housing middle (12B) and a housing rear (12C) with a housing door (12D) removably attached thereto forming a chamber therein. The housing (12) further has a housing left member (12L) and a housing right member (12R) extending perpendicularly downwardly therefrom. The improved hair cutting device (10) further has a brush (14) with a plurality of brush bristles (14A) extending perpendicularly from a brush spindle (14B) which is rotatably mounted at opposite distal ends to the housing left member (12L) and housing right member (12R), respectively. The improved hair cutting device (10) further has a vacuum (16) which comprises a vacuum motor (16A) fastened to a vacuum fan (16B) by a rotating vacuum shaft (16C). The improved hair cutting device (10) further has a power source (18) electrically connected to a vacuum switch (16D).

9 Claims, 3 Drawing Sheets

HAIR CUTTING DEVICE

CROSS REFERENCE TO RELATED APPLICATIONS

This application is an improvement of U.S. Pat. No. 5,519,939 issued on May 28, 1996 titled HAIR CUTTING DEVICE.

FIELD OF THE INVENTION

The present invention relates to an improved hair cutting device. More particularly, the present invention relates to an improved hair cutting device having features such as a comb, cutting blade, rotary brush which functions to lift the hair into proper position enabling cutting by the blade, and a vacuum which functions to remove and collect the cut hair.

DESCRIPTION OF THE PRIOR ART

Hand held self hair cutting implements are well known in the art. The devices must be able to hold the user's hair in a specific orientation to maximize the cutting precision. Three major steps are required to accomplish this task. Firstly, the hair must be lifted away from the head. Secondly, the hair must be held steady for cutting. Thirdly, the blade must be passed across the hair to cut. There exits a need for a self utilizing hair cutting device which is simple and inexpensive to utilize.

Numerous innovations for hair cutting devices have been provided in the prior art that are described as follows. Even though these innovations may be suitable for the specific individual purposes to which they address, they differ from the present invention as hereinafter contrasted.

In U.S. Pat. No. 5,519,939, titled Hair Cutting Device, previously invented by James E. Smith, the inventor of the present invention, the need for hand held cutting implements enabling a user to cut his or her own hair is well established in the prior art. Such implements must hold the hair in an appropriate orientation and then cut the hair to have the intended effect. Three steps are required to achieve the desired result. The first is to lift the hair from the head. The second is to hold the hair steady for cutting, as the blade cuts the strands of hair, and the last is to pass the blade across the hair, thereby cutting it.

In U.S. Pat. No. 4,146,960, titled Thinning Comb For Powered Hair Trimmer, invented by Flowers, a powered hair trimmer is described which is provided with a hair thinning comb. The comb guides strands of hair toward cutter teeth of the trimmer for shearing and inhibits the introduction between the cutter teeth of come of the guided strands.

The patented invention differs from the present invention because the patented invention does not describe the use of a vacuum device for the convenient removal of cut hairs, and further because the patented invention does not include spinning or rotating brush bristles of any sort. In addition, the Flowers invention does not provide for adjustability of length of the subject's hair, as it is more of a standard cutter than a styler. Thus, whereas the present invention can be effectively used by either sex in a variety of applications, the invention by Flowers is more appropriate for use by males than females.

In U.S. Pat. No. 5,142,786, titled Vacuum Drawn Hair Clipper, invented by Hunts, a precision hair clipper for cutting hair to a uniform length comprises a housing defining a flow chamber attachable to a vacuum source. At the inlet of the housing, a pair of reciprocating blades occupy one side of a quadrangle rim. The blades have rows of cooperating teeth facing the opening of the inlet. A bar commensurate with and parallel to the blade teeth is reciprocally translated across the opening between the teeth and the opposite edge of the rim. Hair drawn through the flow chamber is thus periodically pushed against the shearing teeth. The bar movement is coupled to the blade oscillating mechanism.

The patented invention differs from the present invention because the patented invention, although incorporating a vacuum means, still is only designed for curing the subject's hair in uniform lengths. In addition, the vacuum of the patented invention, a separate assembly, is larger as presumably heavier than that of your invention. Finally, the invention by Hunts does not incorporate a rotating brush. Thus, unlike the present invention, the patented invention will not likely provide as precise a cut, since the spinning brush would greatly enhance the amount of hair drawn into the vacuum.

In U.S. Pat. No. 5,377,411, titled Hair Cutting Appliance, invented by Andriotis, a hair cutting appliance comprises an enclosed housing having a hollow handle connecting the housing to a vacuum source to carry away cut hairs from the subject's head. A manually operated or finger depressible member is pivotally mounted on the handle to a manner that the same hand of the user which holds or grips the handle can also operate the finger depressible member which permits the other hand of the user to be free for another purpose.

The patented invention differs from the present invention because the patented invention, much like the previously mentioned Flowers invention, does not include a spinning or rotatable brush portion. Once again, unlike the patented invention, the present invention will likely result in a cleaner vacuuming operation. In addition, the patent by Andriotis does not describe the use of the invention for mustaches or beards, as in your invention. Lastly, an analysis of the drawings of the Andriotis invention reveals an assembly that is likely heavier and less compact than your own.

Numerous innovations for hair cutting devices have been provided in the prior art that are adapted to be used. Even though these innovations may be suitable for the specific individual purposes to which they address, they would not be suitable for the purposes of the present invention as heretofore described.

SUMMARY OF THE INVENTION

The present invention provides an uncomplicated, self-contained implement incorporating a vacuuming feature. In addition to the usual comb and blade, the novel implement includes a rotary brush which supplants the prior art pneumatic pressure components and schemes, while still providing the function of lifting the hair prior to cutting. The vacuum is primarily utilized to collect the hair clippings for easy removal thereof.

The brush is preferably cylindrical at the periphery of the bristles, and the blade is arranged to contact the brush along a line coinciding with the surface of the cylindrical shape. This enables a broad swath of hair corresponding to the length of the brush and the blade to be cut instantaneously during one pass of the implement against the hair. This is as contrasted to scissor action, where there is a point of contact between adjacent blades, the point of contact moving progressively along the length of the blades.

The implement is arranged to be adjustable as to angle of the brush and blades with respect to the handle, and as to effective length of the handle. Also, two sets of combs and blades are provided on opposing sides of the brush, so that operation in opposite directions is enabled. Thus, the novel implement can be used with both the right and left hands.

Adjustability of cutting angle also adapts the novel implement for being oriented appropriate for any individual hair style and length.

Incorporation of a rotary brush frees the user from having to work around on electric cord or vacuum hose. Thus, the novel hair cutting implement is quite versatile in its capabilities, and a user has the option to service almost any existing hair style therewith.

Safety is another important consideration. Most implements shield the cutting blade from the user only to a limited degree. It must be stressed that when a person cuts his or her own hair, it is likely that direct viewing of the work is impossible, and that the potential for injurious wielding of an implement increases. The novel implement addresses this concern by locating its cutting blades in a sheltered location inside the combs, and between the rotary brush and the handle.

Accordingly, it is a principal object of the invention to provide a self-contained implement for cutting hair which lifts the hair, maintains the hair in place, and cuts the hair.

It is another object of the invention to render a cutting implement wherein the angle of the blade is adjustable with respect to orientation to the head and hair of the user.

An additional object of the invention is to enable right and left handed operation of the hair cutting implement.

Still another object of the invention is to locate the cutting blades safely within the implement.

An additional object of the invention is to provide a rotatable brush integrally with the implement.

It is again an object of the invention to contact the cutting edge of the blade along a line of the brush, whereby a broad swath of hair is cut on a pass of the implement against the hair.

Yet another object of the invention is to enable adjustability of the angle of the blade with respect to the hair.

It is an object of the invention to provide improved elements and arrangements thereof in an apparatus for the purposes described which is inexpensive, dependable and fully effective in accomplishing its intended purposes.

The types of problems encountered in the prior art are prior art devices cut hair which thereafter falls to the floor leaving a mess.

In the prior art, unsuccessful attempts to solve this problem were attempted namely: pneumatically activated vacuum devices which suck the hair in prior to cutting it. However, the problem was solved by the present invention because it utilizes the rotating brush to lift and position the hair for cutting and the vacuum is only utilized for collecting the hair clippings.

Innovations within the prior art are rapidly being exploited in the field of self cutting hair devices.

The present invention went contrary to the teaching of the art which describes and claims pneumatic pressurized vacuum hair lifting devices.

The present invention solved a long felt need for a self usable hair cutting device which is capable of collecting the cut hair.

Accordingly, it is an object of the present invention to provide an improved hair cutting device comprising a housing containing a brush, a vacuum, a power means, at least one cutting blade, and a comb.

More particularly, it is an object of the present invention to provide the housing comprising a housing front having a housing front vertical member, a housing front horizontal member, and a housing front bottom support member with a housing front bottom support member fastener.

In keeping with these objects, and with others which will become apparent hereinafter, one feature of the present invention resides, briefly stated, in the housing further comprises a housing middle, a housing rear, a housing door, a housing left member, and a housing right member.

When the brush is designed in accordance with the present invention, it comprises a plurality of brush bristles extending perpendicularly from a brush spindle.

In accordance with another feature of the present invention, a vacuum comprises a vacuum motor attached to a vacuum fan by a vacuum shaft.

Another feature of the present invention is that the vacuum motor is electrically connected to a vacuum switch containing a vacuum ON/OFF switch and a vacuum switch control.

Yet another feature of the present invention is that the power means is preferably a rechargeable power means having a power means plug.

Still another feature of the present invention is that the cutting blade comprises a upper cutting blade having a upper cutting blade adjustment means and a upper cutting blade fastener.

Yet still another feature of the present invention is that the cutting blade further comprises a lower cutting blade having a lower cutting blade adjustment means and a lower cutting blade fastener.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10-improved hair curing device (10)
12-housing (12)
12A-housing front (12A)
12AA-housing front vertical member (12AA)
12AB-housing front horizontal member (12AB)
12C-housing front bottom support member (12AC)
12CA-housing front bottom support member fastener (12ACA)
12B-housing middle (12B)
12C-housing rear (12C)
12D-housing door (12D)
12L-housing left member (12L)
12R-housing right member (12R)
14-brush (14)
14A-brush bristles (14A)
14B-brush spindle (14B)
16-vacuum (16)
16A-vacuum motor (16A)
16B-vacuum fan (16B)
16C-vacuum shaft (16C)
16D-vacuum switch (16D)
16DA-vacuum ON/OFF switch (16DA)
16DB-vacuum switch control (16DB)
18-power means (18)
18A-rechargeable power means (18A)

18B-power means plug (18B)
20-cutting blade (20)
20A-upper cutting blade (20A)
20AA-upper cutting blade adjustment means (20AA)
20AB-upper cutting blade fastener (20AB)
20B-lower cutting blade (20B)
20BA-lower cutting blade adjustment means (20BA)
20BB-lower cutting blade fastener (20BB)
22 comb (22)
20-hair clippings (24)

DESCRIPTION OF THE PREFERRED EMBODIMENT

Figure 1:
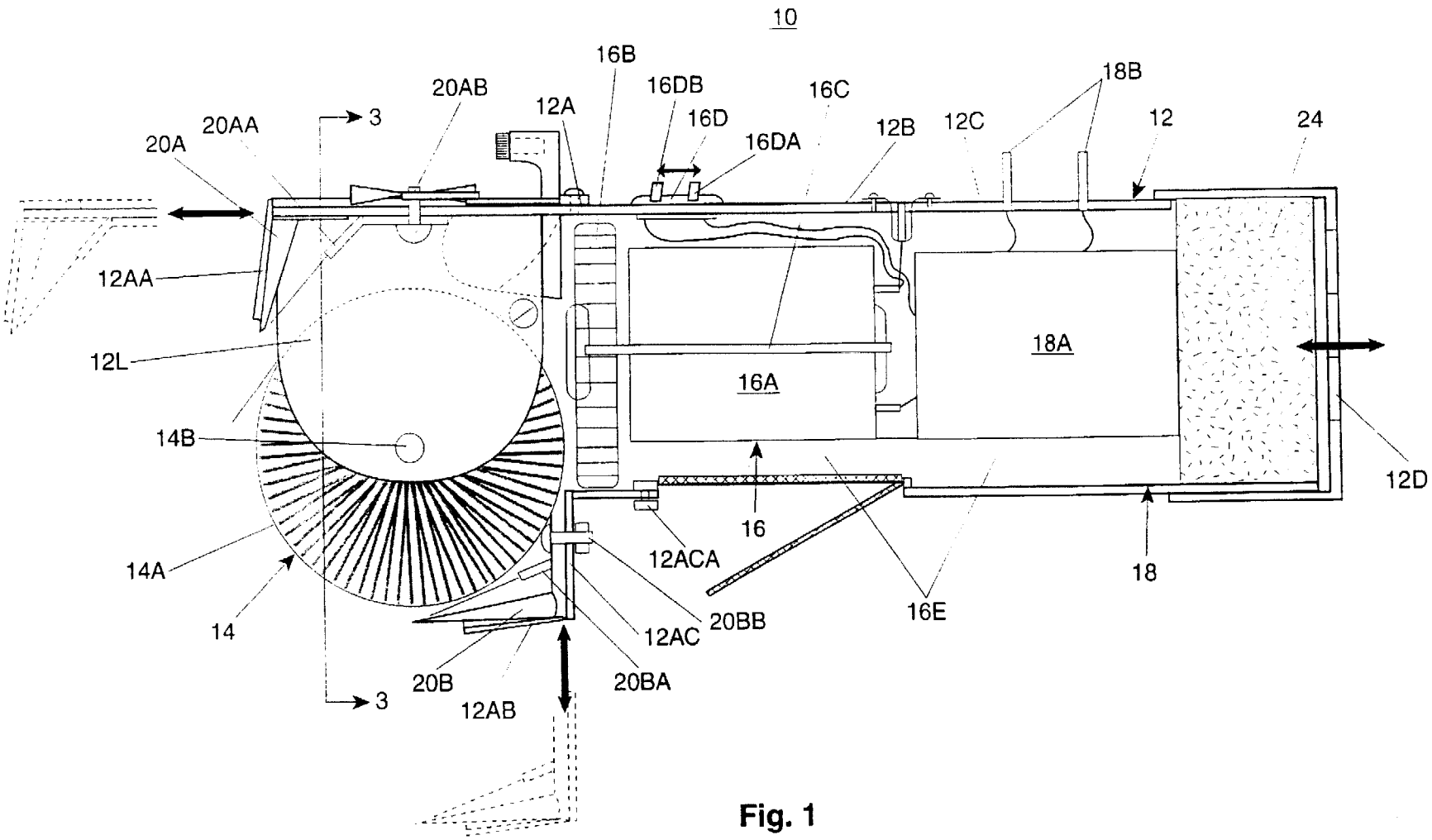
FIG. 1 is a side partial cross-sectional view along an upper lower longitudinal axis of an improved hair cutting device.
Figure 2:
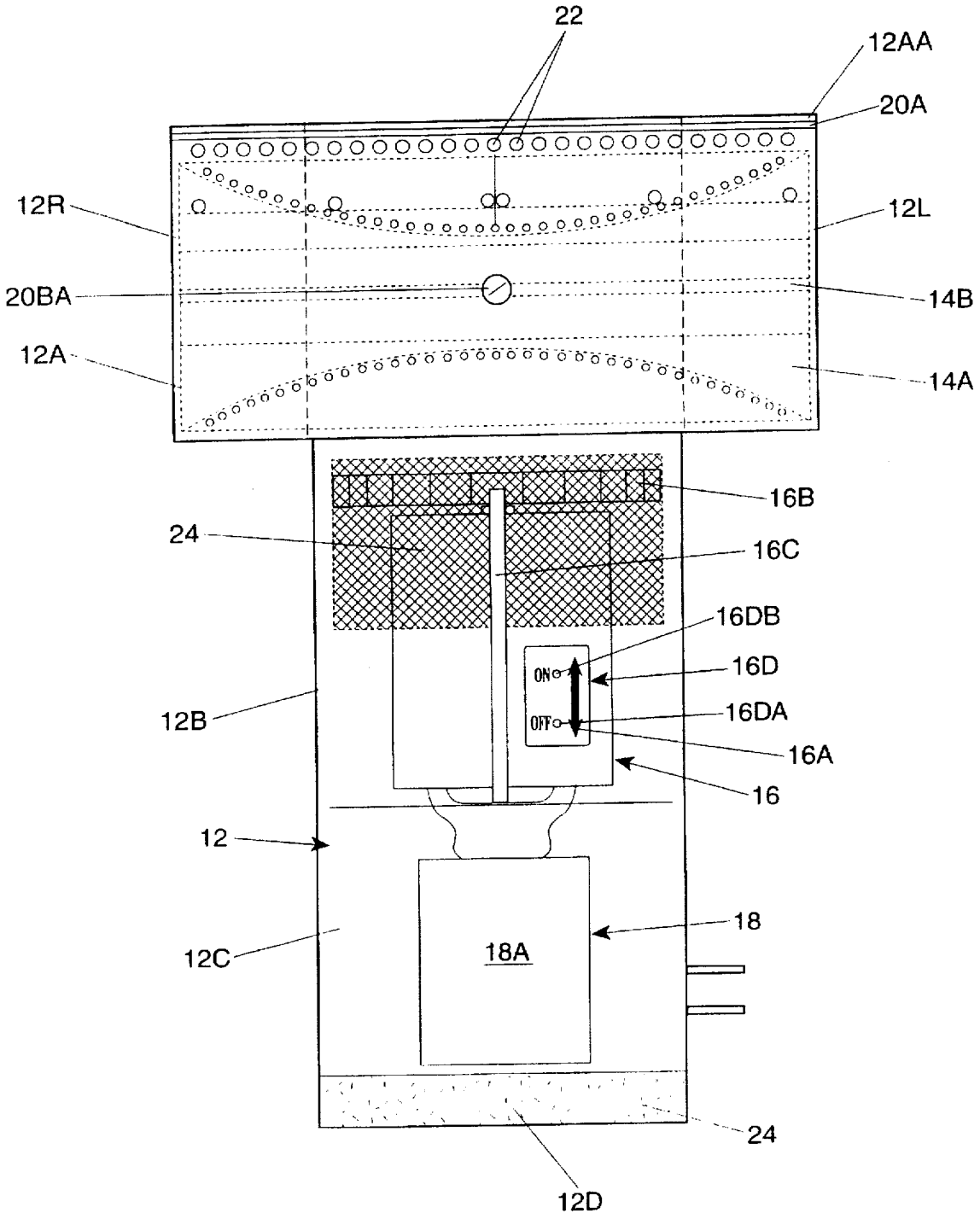
FIG. 2 is a bottom partial cross-sectional view along a left-right longitudinal axis of an improved hair cutting device.
Figure 3:
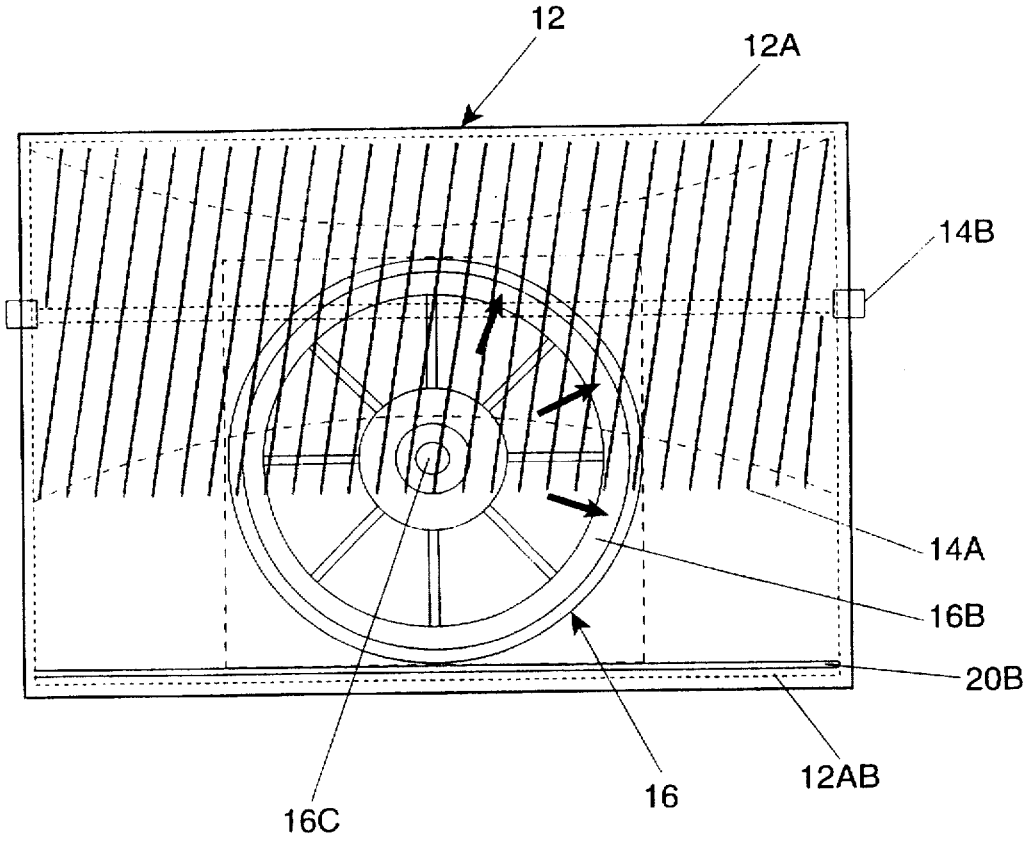
FIG. 3 is a front partial cross-sectional view of an improved hair cutting device along line 3—3 of FIG. 1.
Figure 1:
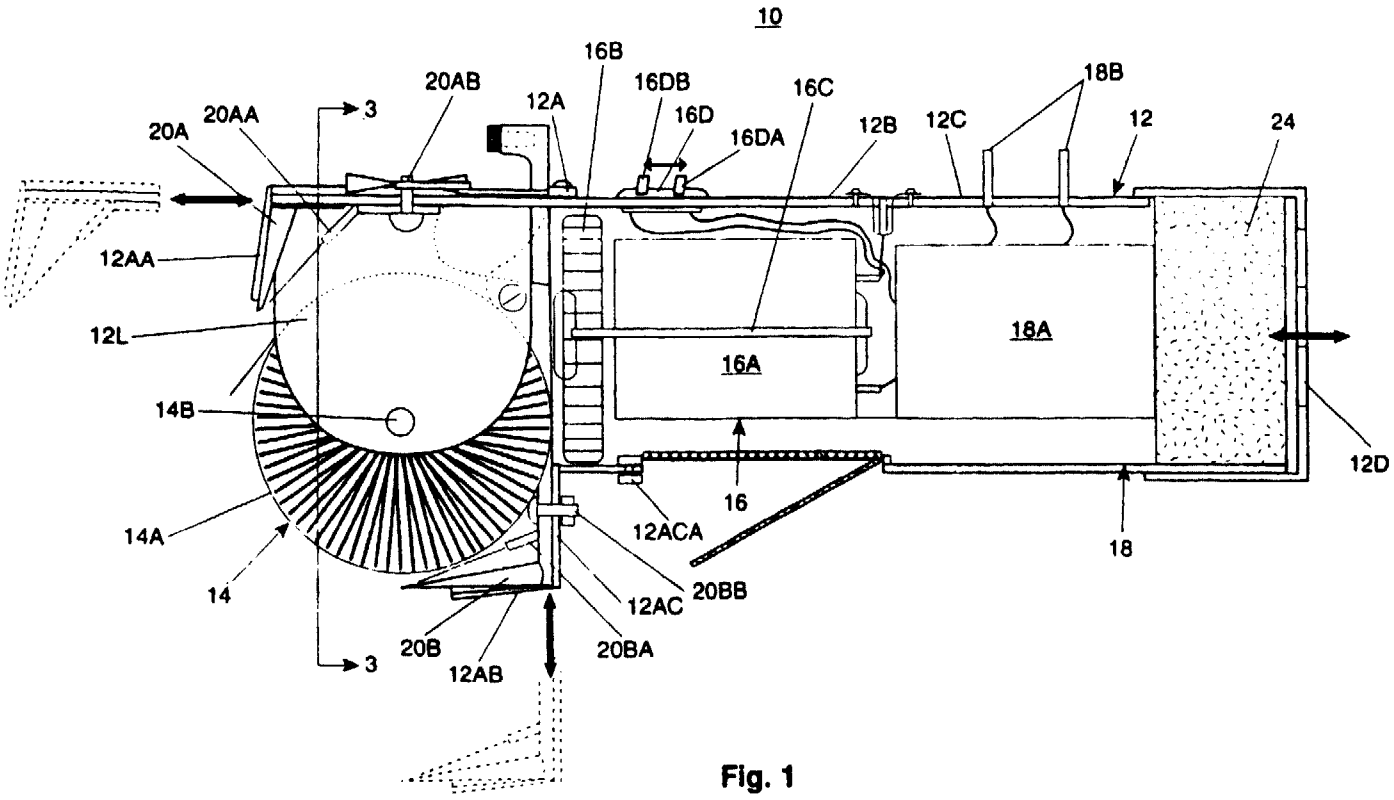

Referring to FIG. 1 which is a side partial cross-sectional view along an upper lower longitudinal axis of an improved hair cutting device and referring to FIG. 2 which is a bottom partial cross-sectional view along a left-right longitudinal axis of an improved hair cutting device. Referring also to FIG. 3 which is a from partial cross-sectional view of an improved hair cutting device along line 3—3 of FIG. 1. The improved hair cutting device (10) comprises a housing (12) which comprises a housing front (12A) having a housing front vertical member (12AA) and a housing front horizontal member (12AB) attached to a housing front bottom support member (12AC). The housing front bottom support member (12AC) is preferably removably attachable to the housing front (12A) by a housing front bottom support member fastener (12ACA). The housing (12) further comprises a housing middle (12B) and a housing rear (12C) having a housing door (12D) removably attached thereto forming a chamber (16E) therein. The housing (12) further comprises a housing left member (12L) and a housing right member (12R) extending perpendicularly downwardly therefrom. The housing (12) is constructed from a material selected from a group consisting of plastic, plastic composite, metal, metal alloy, rubber, rubber composite, fiberglass, epoxy, and carbon-graphite.

The improved hair cutting device (10) further comprises a brush (14) which comprises a plurality of brush bristles (14A) extending perpendicularly from a brush spindle (14B) which is rotatably mounted at opposite distal ends to the housing left member (12L) and housing right member (12R), respectively. The brush (14) is selected from a group consisting of cylindrical, cone shaped, and convex shaped.

The improved hair cutting device (10) further comprises a vacuum (16) which comprises a vacuum motor (16A) fastened to a vacuum fan (16B) by a rotating vacuum shaft (16C). The vacuum motor (16A) is electrically connected to a vacuum switch (16D). The vacuum switch (16D) comprises a vacuum ON/OFF switch (16DA) and a vacuum switch control (16DB) which functions to regulate speed of the vacuum motor (16A) and concurrently regulate vacuum intensity. The vacuum motor (16A) is preferably DC operational but optionally can alternatively be an AC driven motor.

The improved hair cutting device (10) further comprises a power means (18) electrically connected to the vacuum switch (16D). When a user activates the vacuum switch (16D), hair clippings (24) are drawn into the chamber. The power means (18) can optionally be an alternating current commonly found in households. The power means (18) is a rechargeable power means (18A) having a power means plug (18B) electrically attached thereto. The power means plug (18B) allows the device to be plugged directly into an AC socket for recharging.

The improved hair cutting device (10) further comprises at least one upper cutting blade (20A) is positioned in the housing front vertical member (12AA) of the housing front (12A). The at least one upper cutting blade (20A) is adjustably fastened to the housing front (12A) by an upper cutting blade adjustment means (20AA) having an upper cutting blade fastener (20AB). The upper cutting blade adjustment means (20AA) functions to adjust an angle and protrusion length of the at least one upper cutting blade (20A). The brush (14) functions to lift a user's hair into a position wherein the at least one upper cutting blade (20A) functions to sever the user's hair forming hair clippings (24). The least one lower cutting blade (20B) is positioned along the housing front horizontal member (12AB). The at least one lower cutting blade (20B) further comprises a lower cutting blade adjustment means (20BA) having a lower cutting blade fastener (20BB) adjustably attached thereto. The lower cutting blade adjustment means (20BA) functions to adjust an angle and protrusion length of the at least one lower cutting blade (20B). The sharp edge of the cutting blade (20) contacts an external periphery of the brush (14) collectively demarcated by the brush bristles (14A). This enables the improved hair cutting device (10) to contact and cut a broad swath of hair (not shown) along a line coincident with housing front vertical member (12AA).

The improved hair cutting device (10) further comprises a comb (22) is positioned along a longitudinal edge of the housing front vertical member (12AA) behind the at least one upper cutting blade (20A). The comb (22) functions to separate the user's hair during cutting thereof. The comb (22) also functions to prevent a user from cutting his/herself while utilizing the device. The hair is held by comb (22) at a pre-determined orientation for cutting. Thereafter, the hair is lifted into cutting orientation by the brush (14).

It will be understood that each of the elements described above, or two or more together, may also find a useful application in other types of constructions differing from the type described above.

While the invention has been illustrated and described as embodied in an improved hair cutting device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An improved hair cutting device (10) comprising:

A) a housing (12) which comprises a housing front (12A) having a housing front vertical member (12AA) and a housing front horizontal member (12AB) attached to a housing front bottom support member (12AC), the housing (12) further comprises a housing middle (12B) and a housing rear (12C) having a housing door (12D) removably attached thereto forming a chamber therein, the housing (12) further comprises a housing left member (12L) and a housing right member (12R) extending perpendicularly downwardly therefrom;

B) a brush (14) which comprises a plurality of brush bristles (14A) extending perpendicularly from a brush spindle (14B) which is rotatably mounted at opposite distal ends to the housing left member (12L) and the housing right member (12R), respectively;

C) a vacuum (16) which comprises a vacuum motor (16A) fastened to a vacuum fan (16B) by a rotating vacuum shall (16C), the vacuum motor (16A) is electrically connected to a vacuum switch (16D);

D) a power means (18) is electrically connected to the vacuum switch (16D), when a user activates the vacuum switch (16D), hair clippings (24) are drawn into the chamber;

E) at least one upper cutting blade (20A) is positioned in the housing front vertical member (12AA) of the housing front (12A), the at least one upper cutting blade (20A) is adjustably fastened to the housing front (12A) by an upper cutting blade adjustment means (20AA) having an upper cutting blade fastener (20AB), the upper cutting blade adjustment means (20AA) functions to adjust an angle and protrusion length of the at least one upper cutting blade (20A), the brush (14) functions to lift the user's hair into a position wherein the at least one upper cutting blade (20A) functions to sever the user's hair forming hair clippings (24); and F) a comb (22) is positioned along a longitudinal edge of the housing front vertical member (12AA) behind the at least one upper cutting blade (20A), the comb (22) functions to separate the user's hair during cutting thereof.

2. The improved hair cutting device (10) as described in claim 1, wherein the housing (12) is constructed from a material selected from a group consisting of plastic, plastic composite, metal, metal alloy, rubber, rubber composite, fiberglass, epoxy, and carbon-graphite.

3. The improved hair cutting device (10) as described in claim 1, wherein the housing front bottom support member (12AC) is removably attachable to the housing front (12A) by a housing front bottom support member fastener (12ACA).

4. The improved hair cutting device (10) as described in claim 1, wherein the vacuum switch (16D) comprises a vacuum ON/OFF switch (16DA) and a vacuum switch control (16DB) which functions to regulate speed of the vacuum motor (16A) and concurrently regulate vacuum intensity.

5. The improved hair cutting device (10) as described in claim 1, wherein the power means (18) is an alternating current commonly found in households.

6. The improved hair cutting device (10) as described in claim 1, wherein the power means (18) is a rechargeable power means (18A) having a power means plug (18B) electrically attached thereto.

7. The improved hair cutting device (10) as described in claim 1 further comprises at least one lower cutting blade (20B) positioned along the housing front horizontal member (12AB).

8. The improved hair cutting device (10) as described in claim 7, wherein the at least one lower cutting blade (20B) further comprises a lower cutting blade adjustment means (20BA) having a lower cutting blade fastener (20BB) adjustably attached thereto, the lower cutting blade adjustment means (20BA) functions to adjust an angle and protrusion length of the at least one lower cutting blade (20B).

9. The improved hair cutting device (10) as described in claim 1, wherein the brush (14) is selected from a group consisting of cylindrical, cone shaped, and convex shaped.

* * * * *

UNITED STATES PATENT AND TRADEMARK OFFICE

CERTIFICATE OF CORRECTION

PATENT NO. : 5,724,736

DATED : March 10, 1998

INVENTOR(S) : JAMES E. SMITH

It is certified that error appears in the above-identified patent and that said Letters Patent is hereby corrected as shown below:

The Title page, should be deleted to appear as attached title page.

In the drawings sheet one should be deleted to appear as per attached.

Signed and Sealed this

Sixteenth Day of June, 1998

*Attest:*

*Attesting Officer*

BRUCE LEHMAN

*Commissioner of Patents and Trademarks*

US005724736A

United States Patent [19]

Smith

[11] Patent Number: 5,724,736

[45] Date of Patent: Mar. 10, 1998

[54] HAIR CUTTING DEVICE

[76] Inventor: James E. Smith, 10 Elm St., Saraland, Ala. 36571

[21] Appl. No.: 744,094

[22] Filed: Nov. 5, 1996

[51] Int. Cl.[6] ..... B26B 19/44

[52] U.S. Cl. ..... 30/133; 30/30

[58] Field of Search ..... 30/133, 131, 132, 30/30, 31, 200, 201, 415, 195

[56] References Cited

U.S. PATENT DOCUMENTS

| | | | |
|---|---|---|---|
| 2,249,293 | 7/1941 | King | 30/133 |
| 4,030,196 | 6/1977 | Koiwa et al. | 30/133 |
| 4,146,960 | 4/1979 | Flowers et al. | 30/195 |
| 5,031,320 | 7/1991 | Perrys | 30/133 |
| 5,060,380 | 10/1991 | Fujikawa | 30/200 |
| 5,142,786 | 9/1992 | Hunts | 30/133 |
| 5,377,411 | 1/1995 | Andriotis | 30/133 |
| 5,519,939 | 5/1996 | Smith | 30/30 |

*Primary Examiner*—Hwei-Siu Payer

[57] ABSTRACT

An improved hair cutting device (10) having a housing (12) having a housing front (12A) with a housing front vertical member (12AA) and a housing front horizontal member (12AB) attached to a housing front bottom support member (12AC). The housing (12) further has a housing middle (12B) and a housing rear (12C) with a housing door (12D) removably attached thereto forming a chamber therein. The housing (12) further has a housing left member (12L) and a housing right member (12R) extending perpendicularly downwardly therefrom. The improved hair cutting device (10) further has a brush (14) with a plurality of brush bristles (14A) extending perpendicularly from a brush spindle (14B) which is rotatably mounted at opposite distal ends to the housing left member (12L) and housing right member (12R), respectively. The improved hair cutting device (10) further has a vacuum (16) which comprises a vacuum motor (16A) fastened to a vacuum fan (16B) by a rotating vacuum shaft (16C). The improved hair cutting device (10) further has a power source (18) electrically connected to a vacuum switch (16D).

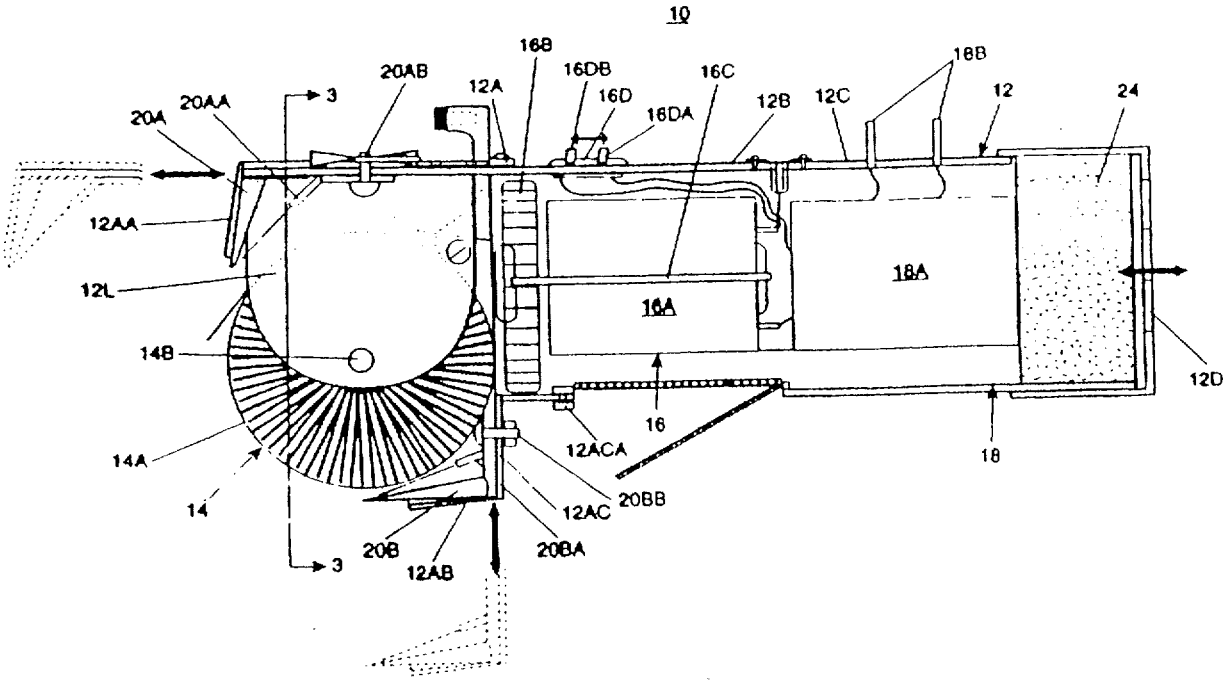

9 Claims, 3 Drawing Sheets